US005803151A

United States Patent [19]

Carden

[11] Patent Number: 5,803,151

[45] Date of Patent: Sep. 8, 1998

[54] SOLUBLE CORE METHOD OF MANUFACTURING METAL CAST PRODUCTS

[75] Inventor: Robin A. Carden, Costa Mesa, Calif.

[73] Assignee: Alyn Corporation, Irvine, Calif.

[21] Appl. No.: 826,551

[22] Filed: Apr. 4, 1997

Related U.S. Application Data

[62] Division of Ser. No. 674,167, Jul. 1, 1996, abandoned.

[51] Int. Cl.[6] ..... B22C 1/00; B22C 3/00; B22C 9/10; B22D 29/00

[52] U.S. Cl. ..... 164/5; 164/132; 164/138; 164/522

[58] Field of Search ..... 164/369, 522, 164/132, 5, 138

[56] References Cited

U.S. PATENT DOCUMENTS

| | | | |
|---|---|---|---|
| 3,407,864 | 10/1968 | Anderko et al. . | |
| 3,963,818 | 6/1976 | Sakoda et al. . | |
| 4,446,906 | 5/1984 | Ackerman et al. | 164/132 X |
| 4,480,681 | 11/1984 | Alexander et al. . | |
| 4,774,990 | 10/1988 | Yamamoto et al. . | |
| 4,840,219 | 6/1989 | Foreman . | |
| 5,012,853 | 5/1991 | Bihlmaier . | |
| 5,303,761 | 4/1994 | Flessner et al. . | |
| 5,361,824 | 11/1994 | Keck et al. . | |

FOREIGN PATENT DOCUMENTS

| | | |
|---|---|---|
| 46-4818 | 2/1971 | Japan . |
| 48-39697 | 11/1973 | Japan . |
| 49-46450 | 12/1974 | Japan . |
| 52-50922 | 4/1977 | Japan . |
| 54-60220 | 5/1979 | Japan . |
| 60-72640 | 4/1985 | Japan . |
| 60-118350 | 6/1985 | Japan . |

*Primary Examiner*—J. Reed Batten, Jr.
*Attorney, Agent, or Firm*—Cooper & Dunham LLP

[57] ABSTRACT

An improved soluble core for die casting metals or metal matrix composites is formed of a mixture of salt and up to about 20 weight % of ceramic material blended together to produce a homogeneous mixture and compacted under pressure to produce a soluble core having little or no porosity. The ceramic material can be in the form of fibers, particulates, whiskers, and/or platelets, and has a melting temperature greater than that of the salt. The core can include a thermally insulating outer ceramic coating to enable the core to withstand higher die casting temperatures than conventional salt cores. The improved soluble core is removable with hot water and/or steam and the core material can be reclaimed for reuse. The process is used to form hollow articles.

8 Claims, 4 Drawing Sheets

SOLUBLE CORE METHOD OF MANUFACTURING METAL CAST PRODUCTS

This application is a division of application Ser. No. 08/674,167 filed Jul. 1, 1996 and now abandoned.

BACKGROUND

The present invention relates generally to soluble core processes for forming hollow chambers and passages within die-cast structures. More particularly, the present invention relates to improved salt-based soluble core processes for use with die-cast metal and/or metal matrix composite structures.

Die casting is a well-known forming technique for producing structures of various shape by pouring a liquid casting material into a pre-shaped mold or die and solidifying the liquid to form an article with the desired shape. This technique, however, does not readily lend itself to producing shapes having internal hollow cavities because the fluidity of the liquid tends to fill all open spaces within the die.

One way to produce an internal cavity in a die-cast structure is to manufacture the structure as two separate halves having respective mating flange portions and respective correlating concave portions. The flange portions are joined together by, for example, welding, and the two concave portions combine to produce an internal cavity. Such a technique, however, is limited to producing shapes having only simple cavity structures, and complex internal passages are generally precluded because of the difficulty in joining internal flange portions. Also, the mechanical properties of structures made by such a technique are likely to be limited by the mechanical properties at the joint region, and thus may be limited by the joining technique used. Further, not all materials can be easily joined.

Soluble core processes have emerged as an attractive alternative method for producing internal hollow cavities and passages in die-cast structures. In a typical soluble core process, a solid core having the dimensions of a desired internal cavity is produced by die casting, as described above. The core may include arm portions that are later used in removing the core. The core is positioned within a die of the desired structure, and a liquid material is cast around the core and solidified. The core is then removed by dissolving it in an appropriate solvent and/or flushing it away with an appropriate fluid, leaving a remaining structure that has a hollow core-shaped internal cavity.

Sand casting is one type of soluble core process. In this process, sand is used as the core material, and the sand is held together with binders to form the core. Once the desired structure is cast around the core, the binder holding the core together is removed by dissolving it and flushing it away with a solvent. The sand, in turn, is also flushed away with the solvent, leaving behind a structure with a hollow internal cavity. A major concern in using this process relates to the environmental hazards of the binder and the difficulty in recovering or reclaiming the binder from the solvent for reuse.

Foam casting is another type of soluble core process, in which the soluble core material is a foam. This process suffers from a number of problems, including the environmental hazards of the foam, the inability to produce a good surface finish, the inability to achieve tight tolerances, and the production of unwanted carbon deposits caused by the trapping of loose foam particles in the liquid casting which then turn into hard carbon deposits.

In contrast to the above-described soluble core processes, salt casting is a relatively environmentally friendly soluble core process capable of producing superior as-cast surface finishes. Salt casting uses a specialized casting salt that contains a high content of soda ash as the core material. The core is produced by die casting, as described above, and the core is later removed with hot water or steam under high pressure. A particular advantage of salt casting is that the salt solution is reclaimable by evaporating the water so that the salt may be reused.

However, conventional salt casting still has a number of drawbacks. One concern in salt casting is the high corrosivity of the molten salt used in die casting the core. This requires the use of special corrosion resistant furnace liners, die liners, and handling equipment. Another concern is the low thermal conductivity of the salt, which can result in non-uniform cooling of the core. If cooling occurs too rapidly, an outer shell solidifies first, and this thermally insulating outer shell deters the molten interior from cooling and solidifying. As a result, if the die is opened before the core is completely solidified, the core is likely to explode. Therefore, great efforts are expended to heat the die to prevent the core from cooling too quickly and forming an insulating shell. Yet another drawback is the need to keep salt cores at temperatures of approximately 315° C. to maintain maximum strength and avoid premature fracture during subsequent casting. Still another drawback is the presence of internal porous regions in the core caused by gases emanating from the molten salt. Such porosity can result in weakening and eventual collapse of a core region during metal casting. A further drawback is the weakness of the salt core at aluminum casting temperatures. If the salt core is allowed to attain such high temperatures for extended periods of time, the core may soften and even liquefy, thus destroying the core and the aluminum structure. The possibility of softening of the core prevents conventional salt casting from being a reliable process for materials having high casting temperatures.

OBJECTS AND SUMMARY OF THE INVENTION

In view of the aforementioned problems and considerations, it is an object of the present invention to provide an improved salt-based soluble core process that can withstand higher metal casting temperatures than those used in conventional salt casting without softening of the salt core.

It is another object of the present invention to provide an improved salt-based soluble core process that is environmentally friendly and that uses reclaimable and reusable materials.

It is a further object of the present invention to provide a process that obviates problems associated with solidification of molten salt by using salt-based soluble cores formed with dry pressing techniques instead.

It is still another object of the present invention to provide hollow articles having a soluble core cast from a metal and/or metal matrix composite.

According to an aspect of the present invention, a core structure containing salt and a small percentage of ceramic material is formed by dry pressing into the shape of an internal passage or cavity. After casting a metal structure around the core using conventional die casting techniques, the core is flushed away with high pressure steam and/or water. The salt-based core material can be reclaimed for reuse by drying off the water.

According to another aspect of the present invention, a core structure containing salt and a small percentage of ceramic material is formed by dry pressing into the shape of an internal passage or cavity. The core is then coated with a thin thermally insulating outer ceramic layer that protects the core from the high temperatures used in metal casting. After casting a metal structure around the core using conventional die casting techniques, the core and the outer ceramic layer are washed away with high pressure steam and/or water. The outer ceramic layer and the salt-based core material can be reclaimed for reuse by drying off the water.

DETAILED DESCRIPTION OF PREFERRED EMBODIMENTS

Figure 1:
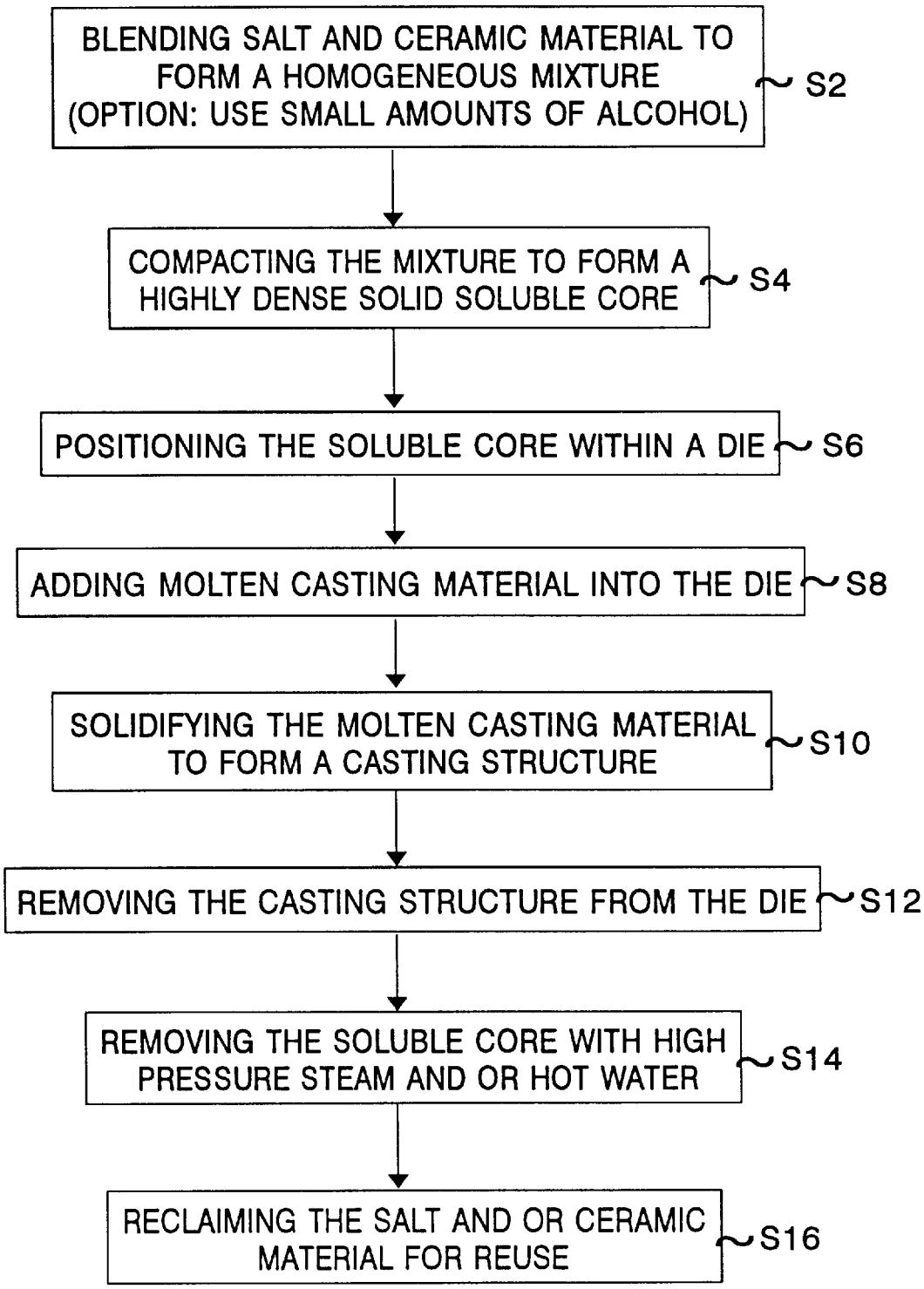
FIG. 1 is a flow chart of a soluble core process according to an embodiment of the present invention.

Preferred embodiments of the present invention are described below with reference to the accompanying drawings, in which like reference numerals represent the same or similar elements.

Figure 2:
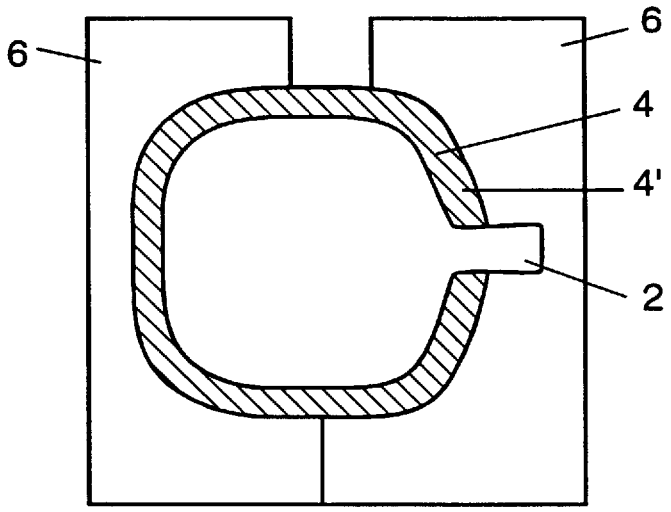
FIG. 2 is a schematic cross-sectional view of a soluble core die-casting apparatus according to the embodiment of FIG. 1.

In an embodiment of the present invention, as described and shown in FIGS. 1 and 2, a soluble core 2 is formed of salt and up to about 20 weight % of ceramic material. The ceramic material can be in the form of fibers, particulates, whiskers and/or platelets, and should have a melting temperature greater than that of the salt and a thermal expansion coefficient comparable to that of the salt. The ceramic material can be an oxide such as aluminum oxide or silicon oxide; a nitride such as boron nitride or silicon nitride; and/or a carbide such as boron carbide, for example. The salt and the ceramic material are blended together at step S2 to produce a homogeneous mixture, which is then compacted under pressure at step S4 into the shape of an internal passage or cavity, that is, a core 2. Typical compacting pressures used are about 10 to 30 kpsi. Such a core 2 is highly dense with little to no porosity and is able to withstand typical aluminum alloy processing temperatures of approximately 675° C. for at least about 30 seconds without softening and/or collapse of the core 2. If desired, small amounts of binder such as polyvinyl alcohol or polycarbonate alcohol may be used in blending the mixture.

Die casting of a metal or metal matrix composite structure is then carried out by positioning the soluble core 2 within a die 6 at step S6, ladling into the die 6 a molten form of the metal or metal matrix composite 4 at step S8, solidifying the molten material 4 at step S10 by cooling the molten material 4 within a dwell time of less than about 30 seconds, removing the solidified casting 4' from the die 6 at step S12, and removing the soluble core from within the casting 4' at step S14 by using high pressure steam and/or hot water to dissolve the salt and flush away the mixture of salt and ceramic material. The solution of salt and ceramic material may be collected and reclaimed for reuse at step S16 by drying off the water.

Figure 3:
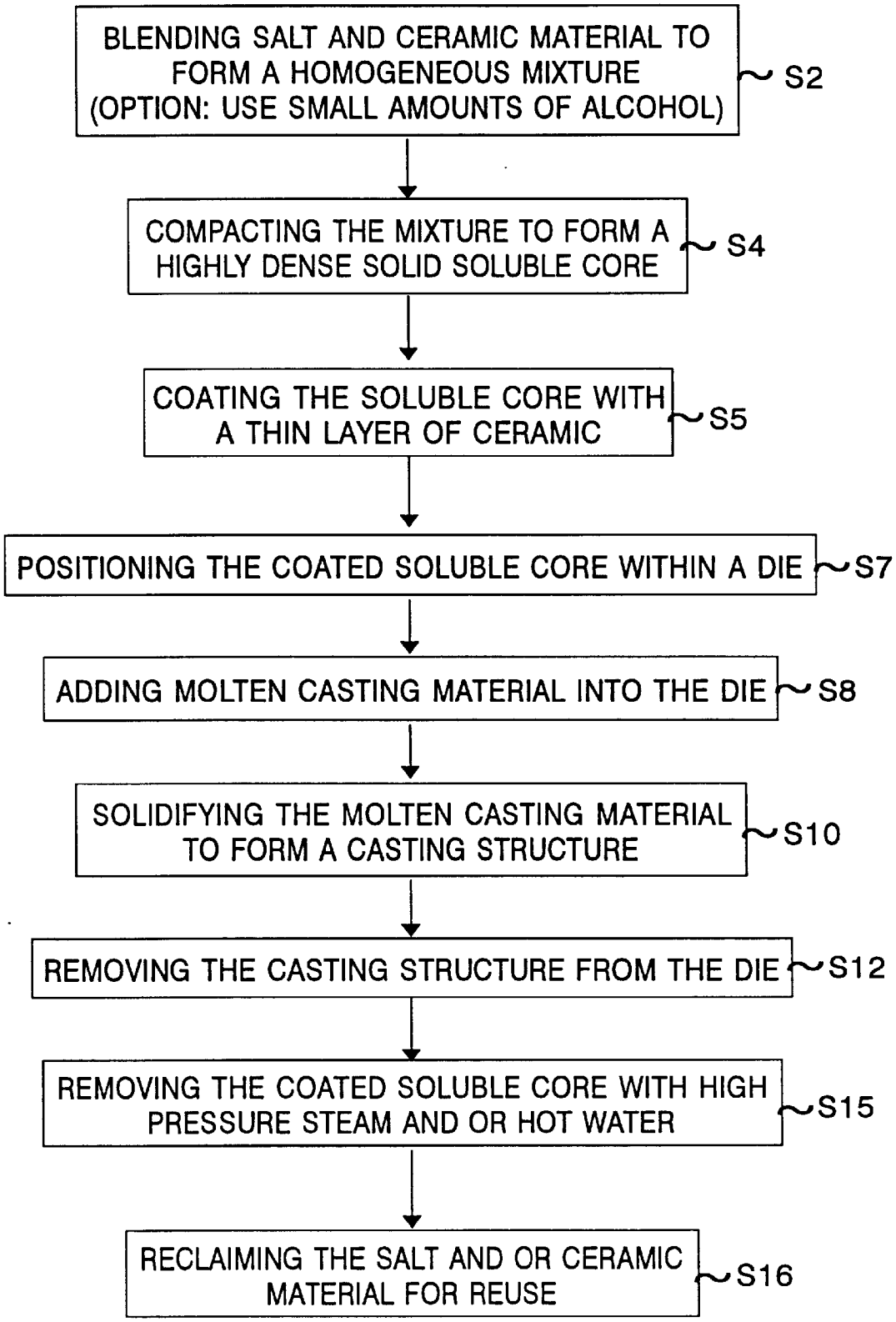
FIG. 3 is a flow chart of a soluble core process according to another embodiment of the present invention.
Figure 4:
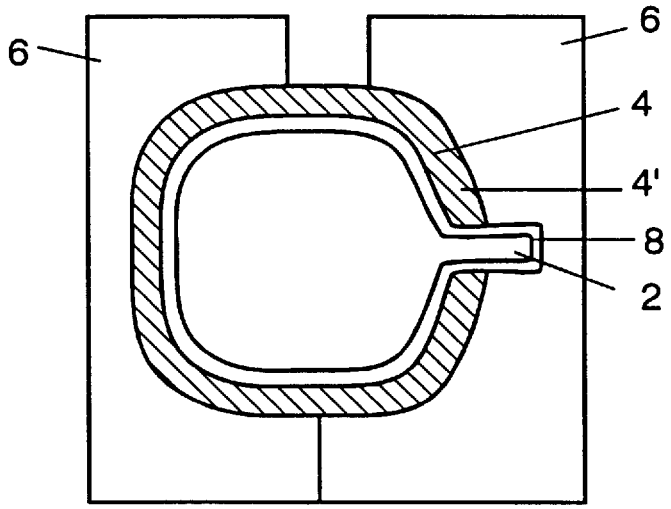
FIG. 4 is a schematic cross-sectional view of a die-casting apparatus according to the embodiment of FIG. 3.

In another embodiment of the present invention, as described and shown in FIGS. 3 and 4, a soluble core 2 is formed of salt and up to about 20 weight % of ceramic material. The ceramic material can be in the form of fibers, particulates, whiskers and/or platelets, and has a melting temperature greater than that of the salt and a thermal expansion coefficient comparable to that of the salt. The salt and the ceramic material are blended together at step S2 to produce a homogeneous mixture, which is then compacted under pressure at step S4 into the shape of a core 2. If desired, small amounts of binder such as polyvinyl alcohol or polycarbonate alcohol may be used in producing the core. Typical pressures used are about 10 to 30 kpsi. Such a core 2 is highly dense with little to no porosity. The core 2 is coated with a thin layer of ceramic 8 at step S5, which acts as a thermal insulation layer that shields the salt-based core 2 from the high temperatures of the molten metal or metal matrix composite 4. The coating 8 can be administered using spraying or dipping techniques, and the coating 8 may consist of an oxide, a nitride, and/or a carbide. Preferably, the coating is comprised of boron nitride. Such a coating 8 enables the core 2 to withstand higher temperatures than conventional uncoated salt cores, thus allowing a wider variety of materials to be cast without softening or collapse of the core 2.

Die casting is then carried out by positioning the coated soluble core 2 within a die 6 at step S7, ladling into the die 6 at step S8 the molten material 4 to be cast, solidifying the molten material 4 at step S10 by cooling the molten material 4, removing the solidified casting 4' from the die 6 at step S12, and removing the coated soluble core 2 from within the casting 4' at step S15 using high pressure steam and/or hot water to dissolve the salt and flush away the mixture of salt and ceramic material. The ceramic coating 8 is also removed along with the core 2. The salt-based solution may be collected and reclaimed for reuse at step S16 by drying off the water.

The process of the invention may be used for die casting a wide range of metals or metal matrix composites. It has been found particularly useful for casting the metal matrix composites described in U.S. Pat. No. 5,486,223.

The soluble core process of the present invention is applicable to manufacturing hollow articles including sporting goods such as golf club heads, baseball bats, and bicycle frames and pedal arms; automotive and motorcycle components such as engine blocks, valves, and structural elements; plumbing fittings and conduits; and numerous other structures having hollow interior passages or cavities such as hollow spheres and ball bearings.

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. A soluble core die casting process comprising the steps of:

blending a water-soluble salt and a ceramic material selected from a group consisting essentially of a nitride, a carbide, and combinations thereof to form a homogeneous mixture, wherein the ceramic material comprises up to 20 weight % of the mixture;

compacting the mixture to form a solid core;

positioning the core within a die;

adding molten casting material into the die;

solidifying the molten casting material to form a casting structure;

removing the casting structure from the die; and removing the core from within the casting structure using steam and/or hot water.

2. A soluble core die casting process according to claim 1, further comprising the step of:

reclaiming the salt and the ceramic material for reuse by removing the water.

3. A soluble core die casting process according to claim 1, wherein the casting material is a metal or a metal matrix composite.

4. A soluble core die casting process according to claim 1, wherein the ceramic material has a melting temperature greater than that of the salt and has a thermal expansion coefficient comparable to that of the salt.

5. A soluble core die casting process according to claim 1, wherein the ceramic material is formed of fibers, particulates, whiskers, or platelets, or a combination thereof.

6. A soluble core die casting process according to claim 1, wherein the mixture is compacted at pressures of about 10 to 30 kpsi and there is little to no porosity in the solid core.

7. A soluble core die casting process comprising the steps of:

blending a water-soluble salt and a ceramic material selected from a group consisting essentially of a nitride, a carbide, and combinations thereof to form a homogeneous mixture, wherein the ceramic material comprises up to 20 weight % of the mixture;

compacting the mixture at a pressure of about 10 to 30 kpsi to form a solid core having little or no porosity;

coating the core with a single layer of a thermally insulating material;

positioning the coated core within a die;

adding molten casting material into the die;

solidifying the molten casting material to form a casting structure;

removing the casting structure from the die;

removing the coated core from within the casting structure using steam and/or hot water; and reclaiming the salt, the ceramic material, and thermally insulating material of the coated core for reuse by removing the water.

8. A soluble core die casting process according to claim 7, wherein the ceramic material is formed of fibers, particulates, whiskers, platelets, or combinations thereof, the ceramic material has a melting temperature greater than that of the salt and a thermal expansion coefficient comparable to that of the salt, and the casting material is a metal or a metal matrix composite.

* * * * *